US012042077B2

(12) United States Patent
Mack et al.

(10) Patent No.: US 12,042,077 B2
(45) Date of Patent: Jul. 23, 2024

(54) CURTAIN CLOSURE DEVICE

(71) Applicants: Courtney Mack, Los Angeles, CA (US); Meredith Rettinger Silver, Los Angeles, CA (US)

(72) Inventors: Courtney Mack, Los Angeles, CA (US); Meredith Rettinger Silver, Los Angeles, CA (US)

( * ) Notice: Subject to any disclaimer, the term of this patent is extended or adjusted under 35 U.S.C. 154(b) by 412 days.

(21) Appl. No.: 17/396,977

(22) Filed: Aug. 9, 2021

(65) Prior Publication Data

US 2023/0020136 A1 Jan. 19, 2023

Related U.S. Application Data

(63) Continuation of application No. 29/799,115, filed on Jul. 13, 2021, now Pat. No. Des. 981,216.

(51) Int. Cl.
*A47H 23/00* (2006.01)
*A47H 23/01* (2006.01)

(52) U.S. Cl.
CPC ..... *A47H 23/01* (2013.01); *A47H 2201/00* (2013.01)

(58) Field of Classification Search
CPC ..... A47H 2201/00; A47H 23/01; Y10T 24/1394; Y10T 24/4088; Y10T 24/44786; Y10T 24/44; Y10T 24/205; Y10T 24/202; B42F 1/10
See application file for complete search history.

(56) References Cited

U.S. PATENT DOCUMENTS 395,473 A * 1/1889 Bartley ..... B42F 1/08 24/546
881,461 A * 3/1908 Craig ..... A44B 11/04 24/265 AL
1,768,977 A * 7/1930 Ealy ..... A61F 13/64 24/570
3,047,060 A 7/1962 Eli
3,905,414 A 9/1975 Guebert et al.
4,188,991 A 2/1980 Boyle
4,213,492 A 7/1980 Guebert et al.
4,437,505 A 3/1984 Rodgers
4,480,356 A * 11/1984 Martin ..... B42F 1/02 40/660
4,874,028 A 10/1989 Lynch et al.
5,524,689 A 6/1996 Clark
5,632,068 A * 5/1997 Riley ..... A47C 31/11 297/228.11

(Continued)

*Primary Examiner* — Robert Sandy
*Assistant Examiner* — Michael S Lee
(74) *Attorney, Agent, or Firm* — Argus Intellectual Enterprise, LLC; Jordan Sworen; Daniel Enea

(57) ABSTRACT

A curtain closure device for securing a pair of curtains in a closed and secure position. The curtain closure device includes a clip having a first side and a second side, wherein the first side can secure to a first curtain and the second side can simultaneously secure to a second curtain. Each side of the clip includes a pressure member having a pair of slots substantially parallel to one another and an opening disposed along a respective side of the clip to receive an edge of the respective curtain therein. The pressure members can apply a force towards a cross member of the clip to retain the curtains in a secured position. In some embodiments, the clip is transparent to prevent obstruction of the design of the curtain.

11 Claims, 5 Drawing Sheets

(56) References Cited

U.S. PATENT DOCUMENTS

| | | | | |
|---|---|---|---|---|
| 2005/0150084 | A1* | 7/2005 | Dreyer | B42F 1/06 24/67.9 |
| 2009/0032205 | A1 | 2/2009 | Goodner et al. | |
| 2016/0258154 | A1* | 9/2016 | Logic | E04G 21/30 |

* cited by examiner

CURTAIN CLOSURE DEVICE

BACKGROUND OF THE INVENTION

The present invention relates to a curtain closure device. The present invention further provides a curtain closure device having a clip with a first side and a second side, wherein each side is configured to cause the adjacent curtains to fasten and overlap.

It is difficult for many people while traveling and at home to remain asleep after the sun rises due to being awaken by sunlight passing through the curtains. Many people will attempt to close the curtains as much as possible. However, oftentimes the curtains are suspended from a single rod and are not configured to overlap. The curtains will simply abut in one location, near the attachment to the rod, and will remain at least slightly separated along the entire length thereof, allowing flickering sunlight to creep into one's room and disturb one's sleep.

Some devices exist that provide a blackout effect of curtains. However, these devices are complex assemblies that require multiple components to install along a curtain rod. When traveling, it is inconvenient to not only travel with these existing systems, but also many hotels and other temporary accommodation will prevent tampering with their curtain installation. Therefore, there exists a need for a curtain closure device having a clip that easily and conveniently fastens to adjacent curtains and configured to cause the adjacent curtains to fasten and overlap in order to prevent any light from passing therethrough.

In light of the devices disclosed in the known art, it is submitted that the present invention substantially diverges in design elements and methods from the known art and consequently it is clear that there is a need in the art for an improvement for a curtain closure device. In this regard the instant invention substantially fulfills these needs.

SUMMARY OF THE INVENTION

In view of the foregoing disadvantages inherent in the known types of curtain closure devices now present in the known art, the present invention provides a new curtain closure device wherein the same can be utilized for quickly and conveniently securing to a pair of adjacent curtains and causing the adjacent curtains to fasten and overlap.

It is an objective of the present invention to provide an embodiment of a curtain closure device comprising a clip having a first side and a second side, wherein the first side is configured to secure to a first curtain and the second side is configured to simultaneously secure to a second curtain. The first side comprises a first pressure member and the second side comprises a second pressure member, wherein the first and second pressure members each comprises a pair of slots substantially parallel to one another having an opening disposed along the first side and second side, respectively, to receive an edge of the first curtain and second curtain, respectively, therein. Once disposed within the opening, the pressure member applies force against the a member to retain the curtain in a secured position.

It is another objective of the present invention to provide an embodiment of a curtain closure device wherein the first side and the second side of the clip each comprise a first arm, a second arm, and a third arm, wherein the arms are disposed in a stacked orientation.

It is another objective of the present invention to provide an embodiment of a curtain closure device wherein a distal end of each arm curves away from a face of the clip, such that the distal end of the first and third arms curves away in an opposite direction as the distal end of the second arms.

It is another objective of the present invention to provide an embodiment of a curtain closure device wherein the clip is entirely transparent.

It is another objective of the present invention to provide an embodiment of a curtain closure device wherein the clip is symmetrical about a horizontal axis.

It is another objective of the present invention to provide a method for securing a first curtain and a second curtain together, comprising providing a clip having a first side and a second side, wherein the first side is configured to secure the first curtain to the clip and the second side is configured to simultaneously secure the second curtain to the clip; wherein the first side comprises a first pressure member and the second side comprises a second pressure member; wherein the first pressure member comprises a pair of slots substantially parallel to one another having an opening disposed along the first side to receive an edge of the first curtain therein; wherein the second pressure member comprises a pair of slots substantially parallel to one another having an opening disposed along the second side to receive an edge of the second curtain therein; inserting a lateral edge of the first curtain into the slots of the first side of the clip; inserting a lateral edge of the second curtain into the slots of the second side of the clip; overlapping the first curtain with the second curtain while disposed with the first and second sides of the clip.

It is therefore an object of the present invention to provide a new and improved curtain closure device that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Reference is made herein to the attached drawings. For the purposes of presenting a brief and clear description of the present invention, the preferred embodiment will be discussed as used for quickly and conveniently securing to a pair of adjacent curtains and causing the adjacent curtains to fasten and overlap. The figures are intended for representative purposes only and should not be considered to be limiting in any respect.

Figure 1:
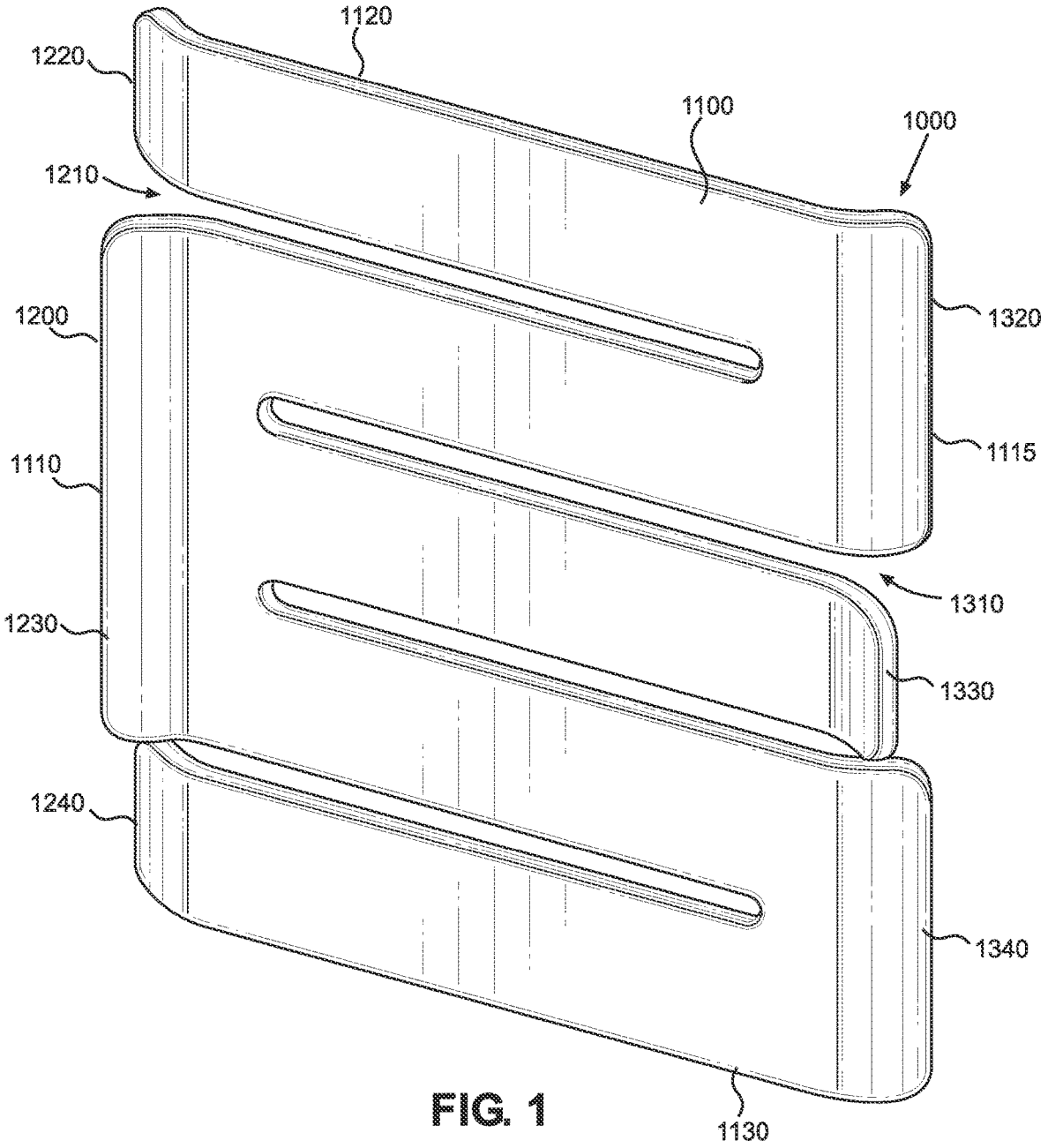
FIG. 1 shows a perspective view of an embodiment of the curtain closure device.
Figure 2:
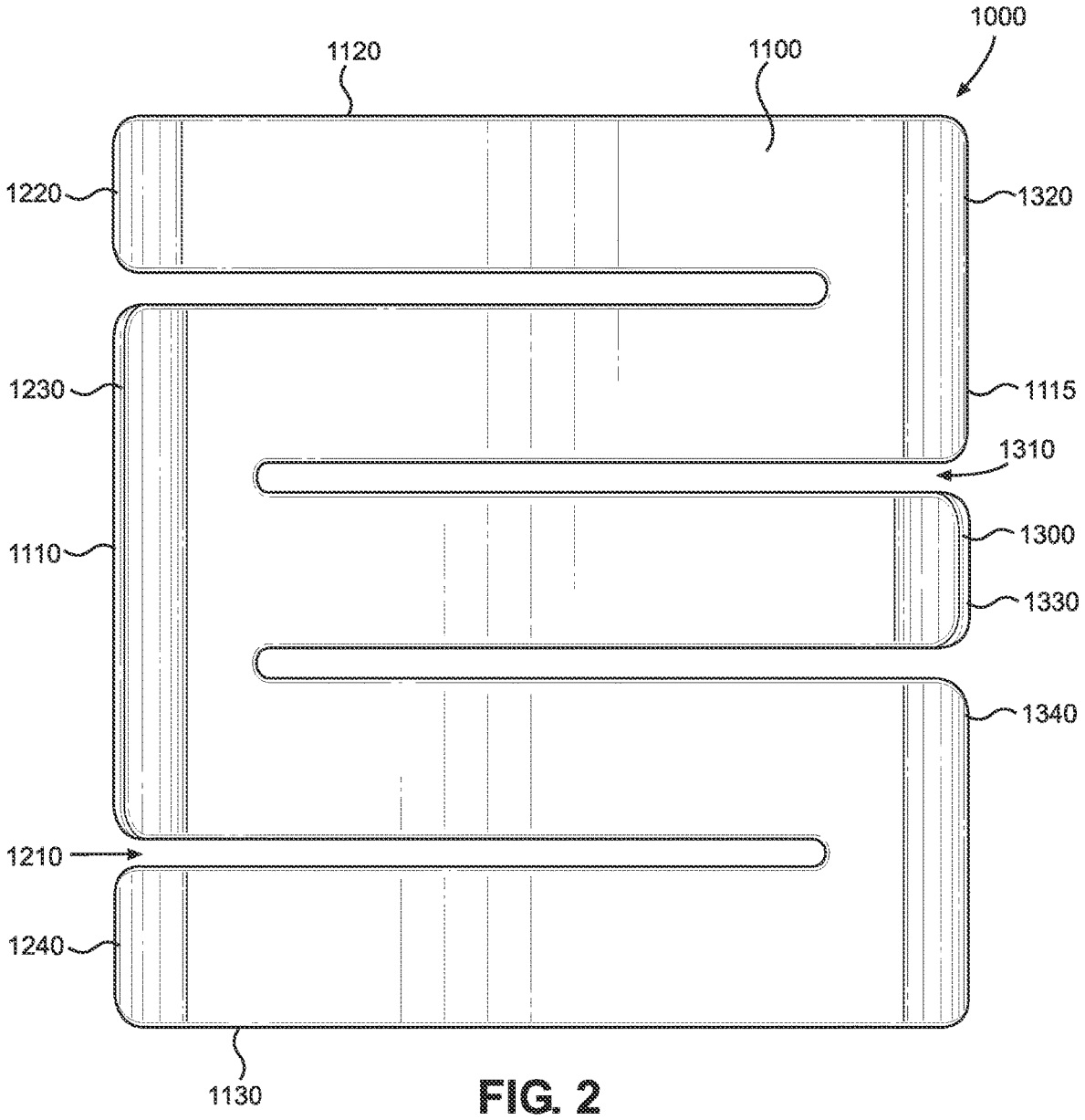
FIG. 2 shows a front view of an embodiment of the curtain closure device.

Referring now to FIGS. 1 and 2, there is shown a perspective view and a front view of an embodiment of the curtain closure device, respectively. The curtain closure device 1000 is configured to secure to adjacent curtains and cause the adjacent curtains to fasten and overlap, thereby preventing sunlight from passing through a gap otherwise formed between the curtains. The curtain closure device 1000 provides a fastener that allows for an easy and convenient way to transform curtains into blackout curtains without requiring installation of any type of secondary curtain, curtain modification or curtain assembly.

The curtain closure device 1000 comprises a clip 1100 having a first side 1110 and an opposing second side 1115. The first side 1110 comprises a first pressure member 1200 and the second side 1115 comprises a second pressure member 1300. The first pressure member 1200 is configured to secure to a first curtain and the second pressure member 1300 is configured to simultaneously secure to a second curtain. Each pressure member 1200, 1300 member comprises a pair of slots 1210, 1310 substantially parallel to one another. The slots 1210 of the first pressure member 1200 each have an opening disposed along the first side 1110 of the clip 1100 to receive an edge of the first curtain therein, whereas the slots 1310 of the second pressure member 1300 each have an opening disposed along the second side 1115 of the clip 1100 to receive an edge of the second curtain. In the illustrated embodiment, all of the slots 1210, 1310 comprise a same length and a same width, wherein the length is measured between the first and second sides 1110, 1115 of the clip 1100 and the width is measured between an upper and an opposing lower end 1120, 1130 of the clip 1100. In alternate embodiments, the length and the width of each slot varies. In the illustrated embodiment, the clip is symmetrical about a horizontal axis.

In the illustrated embodiment, the slots 1210, 1310 extend a majority of the length of the clip 1100, wherein the slots of the first pressure member overlap a same vertical axis as the slots of the second pressure member. In this way, the first and second curtain panels overlap one another when secured to the clip 1100. The vertical axis extends between the upper and lower ends of the clip 1100. The slots 1310 of the second pressure member 1300 are disposed between the slots 1210 of the first pressure member 1200.

In the illustrated embodiment, the first and second pressure members 1200, 1300 each comprise a first arm 1220, 1320, a second arm 1230, 1330, and a third arm 1240, 1340. All of the arms are disposed in a stacked orientation along a vertical plane. When in the secured position, the first and third members apply a force on the curtain that opposes a force from the second member. The pressure members 1200, 1300 are rigid and biased to remain along a same plane, thereby adapted to apply an opposing force on the curtains to retain each respective curtain in a secured position when forced apart by the curtain being positioned therebetween. In the illustrated embodiment, the first and third arms 1320, 1340 of the second side 1115 comprise a greater width than the first and third arms 1220, 1240 of the first side 1110. The second arm 1230 of the first side 1110 comprise a greater width than the second arm 1330 of the second side 1115.

In the illustrated embodiment, the curtain closure device 1000 is composed of injection molded polycarbonate. However, in alternate embodiments, the curtain closure device 1000 is formed from any suitable rigid material. In some embodiments, the curtain closure device 1000 is transparent in order to prevent the device from interfering with the design of the curtain to which it is attached. In alternate embodiments, the clip is semi-transparent or translucent. In other embodiments, the clip comprises a color or pattern to correspond to a color or pattern of the curtains.

Figure 3:
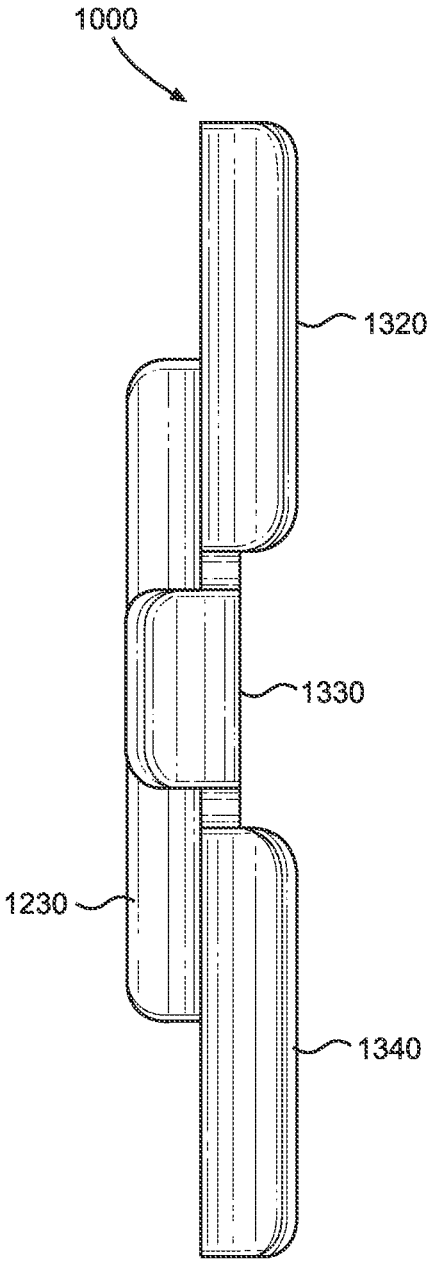
FIG. 3 shows a second side view of an embodiment of the curtain closure device.
Figure 4:
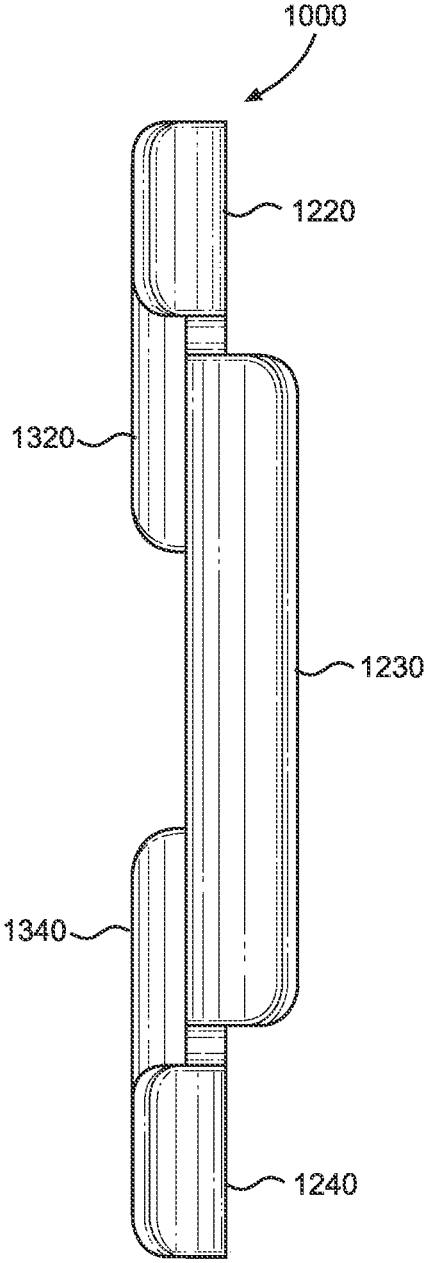
FIG. 4 shows a first side view of an embodiment of the curtain closure device.
Figure 5:
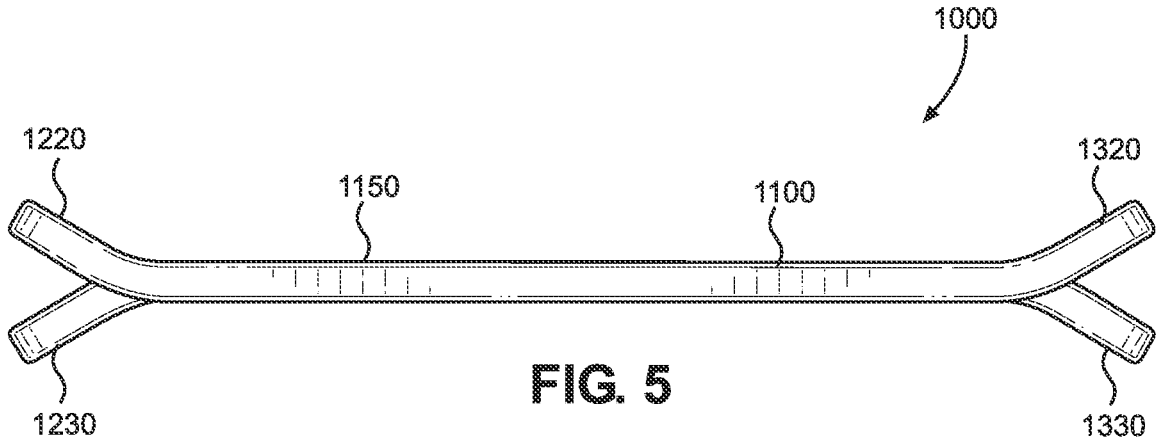
FIG. 5 shows a top planar view of an embodiment of the curtain closure device.

Referring now to FIGS. 3-5, there are shown a side views of an embodiment of the curtain closure device and a top planar view of an embodiment of the curtain closure device, respectively. In the illustrated embodiment, a distal end of each arm comprises a guide tab 1400 that curves away from a face 1150 of the clip 1100. The guide tab 1400 of the first and third arms curves away in an opposite direction as the guide tab 1400 of the second arms 1230, 1330. In the illustrated embodiment, the entire edge of each guide tab is curved. The guide tabs of each side alternate in direction forming a V-shape (seen in FIG. 5) configured to guide and receive a curtain therein. The tab guides the curtain so as to engage each pressure member without snagging or otherwise being caught onto the curtains.

Figure 6:
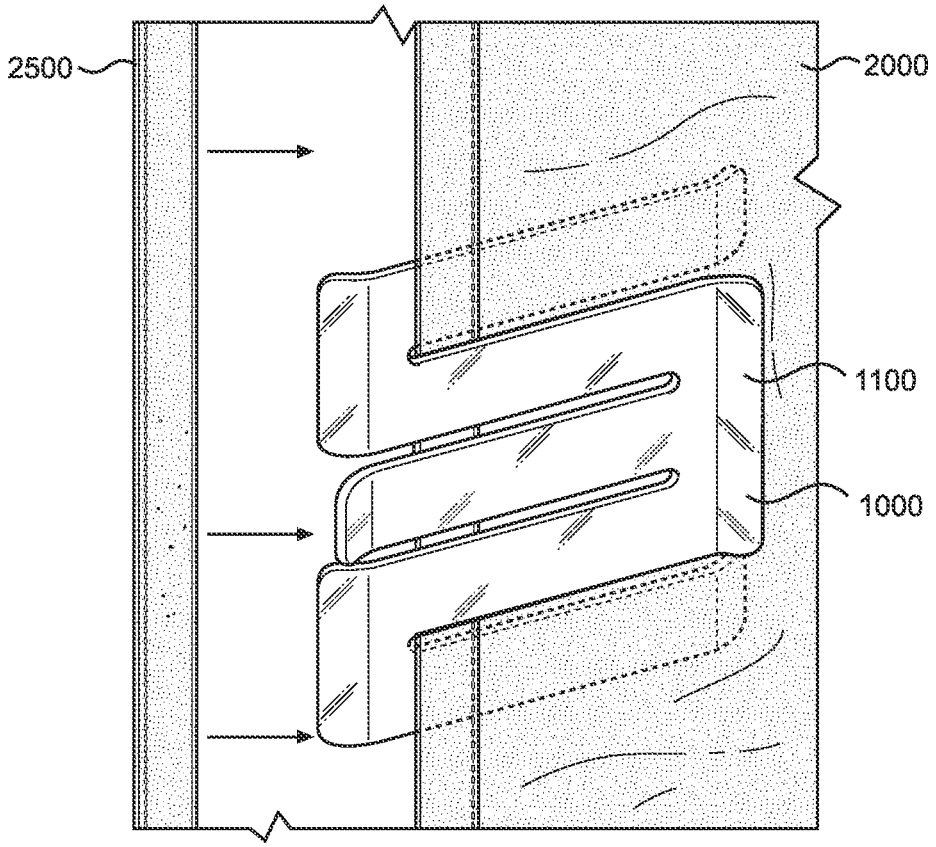
FIG. 6 shows a perspective view of an embodiment of the curtain closure device secured to a curtain.
Figure 7:
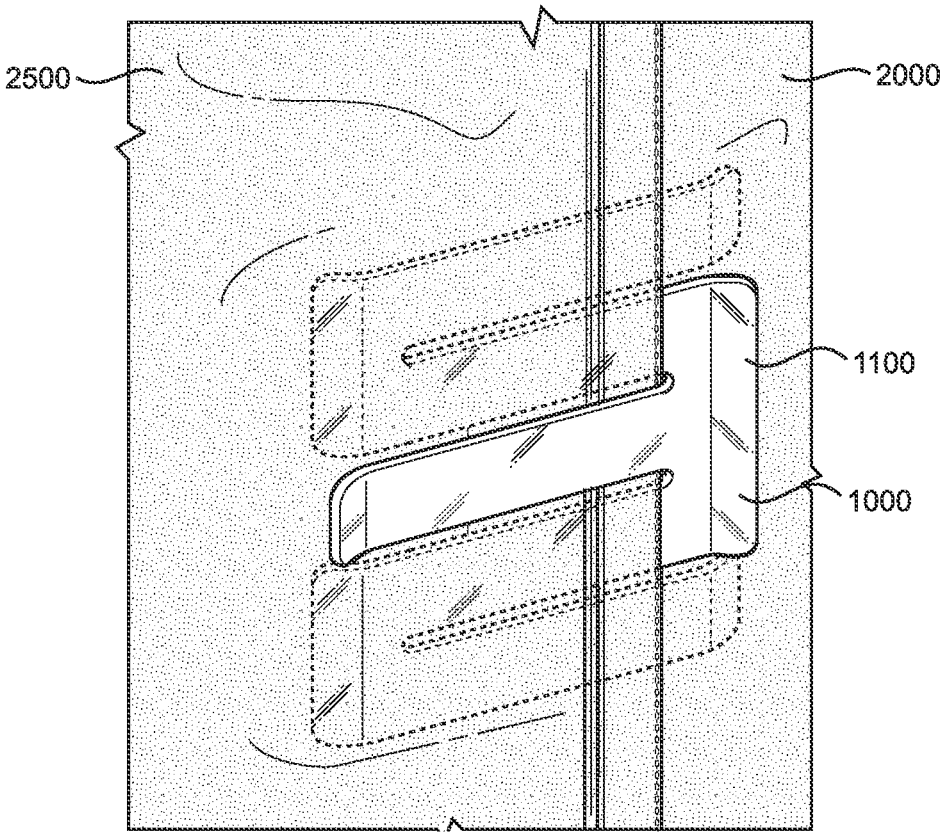
FIG. 7 shows a perspective view of an embodiment of the curtain closure device in use.

Referring now to FIGS. 6 and 7, there is shown a perspective view of an embodiment of the curtain closure device secured to a curtain and a perspective view of a perspective view of an embodiment of the curtain closure device in use, respectively. In the illustrated embodiment, a method for securing a first curtain 2000 and a second curtain 2500 or curtain panels together comprises providing a curtain closure device 1000 having a clip 1100 with a first side and a second side, wherein the first side is configured to secure the first curtain to the clip and the second side is configured to simultaneously secure the second curtain to the clip. The first side comprises a first pressure member and the second side comprises a second pressure member, wherein each pressure member comprises a pair of slots substantially parallel to one another having an opening disposed along their respective side to receive an edge of the respective curtain therein. A lateral edge of each curtain is inserted into the slots of the clip, causing the first and second curtains to overlap while simultaneously disposed within the first and second sides of the clip. In this way, light is prevented from passing between the adjoining edges of the curtains.

In operation, each pressure member applies force against the curtain to retain the curtain in a secured position. In some embodiments, the curtain closure device 1000 comprises a plurality of clips 1100, wherein the clips are configured to be positioned along a length of the curtains so that the adjacent curtains are secured to each other along multiple closure points.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A curtain closure device, comprising:

a clip having a first side and a second side, wherein the first side is configured to secure to a first curtain and the second side is configured to simultaneously secure to a second curtain;

wherein the first side comprises a first pressure member and the second side comprises a second pressure member;

wherein the first pressure member comprises a pair of slots substantially parallel to one another having an opening disposed along the first side to receive an edge of the first curtain therein;

wherein the second pressure member comprises a pair of slots substantially parallel to one another having an opening disposed along the second side to receive an edge of the second curtain therein;

wherein the first pressure member and the second pressure member of the clip each comprise a first arm, a second arm, and a third arm, wherein the arms are disposed in a stacked orientation;

wherein a distal end of each arm curves away from a face of the clip forming a guide tab.

2. The curtain closure device of claim 1, wherein the slots of the second pressure member are disposed between the slots of the first pressure member.

3. The curtain closure device of claim 1, wherein the clip is transparent.

4. The curtain closure device of claim 1, wherein the first arm and the third arm of the first pressure member are adapted to apply a force towards the second arm of the first pressure member when the first curtain is disposed within the clip and wherein the first arm and the third arm of the second pressure member are adapted to apply a force towards the second arm of the second pressure member when the second curtain is disposed within the clip to retain each respective curtain in a secured position.

5. The curtain closure device of claim 1, wherein the guide tab of the first and third arms curves away in an opposite direction as the guide tab of the second arms.

6. The curtain closure device of claim 5, wherein an entire edge of each guide tab is curved.

7. The curtain closure device of claim 1, wherein the first and third arms of the second side comprise a greater width than the first and third arms of the first side.

8. The curtain closure device of claim 1, wherein the second arm of the first side comprise a greater width than the second arm of the second side.

9. The curtain closure device of claim 1, wherein the slots extend a majority of a length of the clip, wherein the length is measured between the first and second sides.

10. The curtain closure device of claim 1, wherein the clip is symmetrical about a horizontal axis.

11. A method for securing a first curtain and a second curtain together, comprising:

providing a clip having a first side and a second side, wherein the first side is configured to secure the first curtain to the clip and the second side is configured to simultaneously secure the second curtain to the clip;

wherein the first side comprises a first pressure member and the second side comprises a second pressure member;

wherein the first pressure member comprises a pair of slots substantially parallel to one another having an opening disposed along the first side to receive an edge of the first curtain therein;

wherein the second pressure member comprises a pair of slots substantially parallel to one another having an opening disposed along the second side to receive an edge of the second curtain therein;

inserting a lateral edge of the first curtain into the slots of the first side of the clip;

inserting a lateral edge of the second curtain into the slots of the second side of the clip;

overlapping the first curtain with the second curtain while disposed with the first and second sides of the clip.

* * * * *